United States Patent [19]

Castellano

[11] 4,174,581

[45] Nov. 20, 1979

[54] GUNSIGHT MOUNT FOR WINCHESTER RIFLE

[76] Inventor: Joseph C. Castellano, 128 Shrewsbury Ave., Red Bank, N.J. 07701

[21] Appl. No.: 865,371

[22] Filed: Dec. 29, 1977

[51] Int. Cl.[2] ..... F41G 1/38

[52] U.S. Cl. ..... 42/1 ST

[58] Field of Search ..... 42/1 ST; 33/245-250

[56] References Cited

U.S. PATENT DOCUMENTS

| | | | |
|---|---|---|---|
| 2,545,419 | 3/1951 | Williams | 42/1 ST |
| 2,583,260 | 1/1952 | Felix | 42/1 ST |
| 3,834,052 | 9/1974 | Steck | 42/1 ST |
| 3,986,285 | 10/1976 | Krisay | 42/1 ST |
| 4,044,486 | 8/1977 | VanHolten | 42/1 ST |

*Primary Examiner*—Charles T. Jordan

*Attorney, Agent, or Firm*—Howard I. Podell

[57] ABSTRACT

A telescopic sight mount for securing a telescopic sight to a "Winchester" 94 type rifle provided with standard iron sights which consists of an elongated member for attachment to the near side face of a gun receiver and having an upper face bent at a right angle thereto over the iron sights for securing thereto the telescopic sight forward of the ejection port of the rifle.

2 Claims, 4 Drawing Figures

GUNSIGHT MOUNT FOR WINCHESTER RIFLE

FIELD OF THE INVENTION

This invention relates generally to a gun sight mount for a "Winchester" type rifle.

DESCRIPTION OF THE PRIOR ART

The prior art, as exemplified by U.S. Pat. Nos. 2,810,963; 2,635,341; 3,671,000 and 1,856,549 is generally illustrative of various devices of this type. While such devices are generally acceptable for their intended purpose they have not proven to be entirely satisfactory in that they are either complex and expensive to manufacture, or bulky and inconvenient to use, or to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a telescopic sight mount for securing a telescopic sight to a "Winchester" 94 type rifle provided with standard iron sights which consists of an elongated member for attachment to the near side face of a gun receiver and having an upper face bent at a right angle thereto over the iron sights for securing thereto the telescopic sight forward of the ejection port of the rifle.

BRIEF DESCRIPTION OF THE DRAWING

In the accompanying drawing, are shown two of the various possible illustrative embodiments of this invention, wherein like reference character identify the same or like parts.

Figure 1:
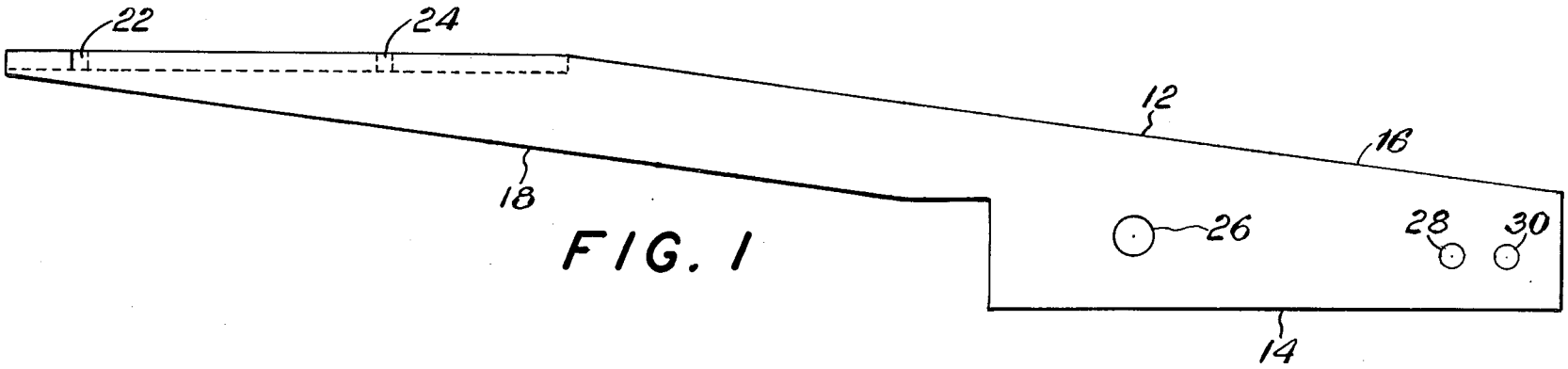
FIG. 1 is a side view of the device of the invention.
Figure 2:
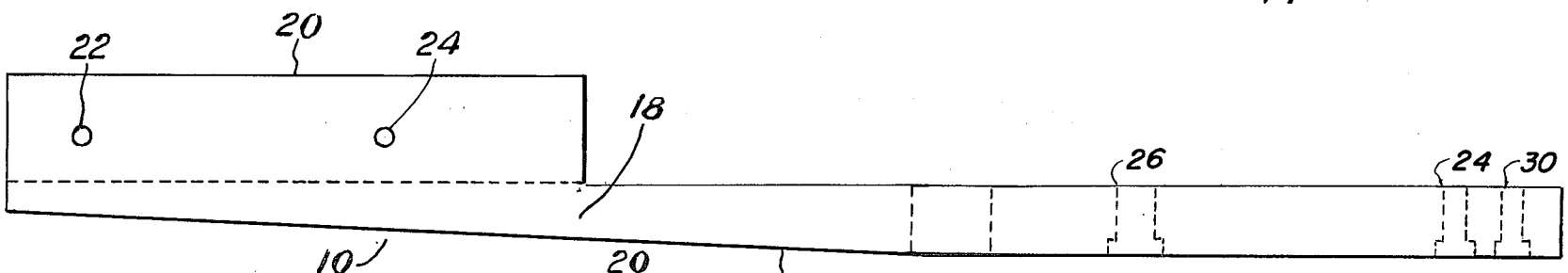
FIG. 2 is a top plan view thereof.

The rifle on which this invention is mounted is the model 1894 rifle, well known by the trade mark of "Winchester", "Winchester" 1894 or "Winchester" 94.

The mount of this invention is characterized by the following advantageous features:

1. The scope is mounted using the pre-drilled mount holes on the side of the gun.

2. It permits a scope to be mounted on the gun on top of the rear sights but not on them, thus allowing the user to use either iron or scope sights, also allowing the free ejection of an empty cartridge through the top of rifle.

3. Easier packing in a case, and contouring to the outlines of the gun.

4. It is well balanced.

5. It is to be used with a low power scope 1.1 X or 2.5 X when hunting in heavy wooded areas where a high power scope cannot be used.

DESCRIPTION OF THE PREFERRED EMBODIMENT

With reference to the drawing, there is shown and illustrated a gun sight mount constructed in accordance with the principles of the invention and designated generally by reference character 10. The illustrated tangible embodiment of the invention includes an elongated member 12 having a substantially straight lower side portion 14 with an upwardly sloping portion 16 forming its upper side. An upwardly sloping segment 18 extends from side portion 14 to a horizontal scope carrier 20 integrally made therewith and bent at 90 degrees relative thereto. Spaced apart openings 22 and 24 are drilled in carrier 20 to accomodate screws for securing thereto the gun sight (not shown).

Openings 26, 28 and 30 are drilled in side portion 14 to correspond with pre-drilled, existing screw holes 32 in gun receiver 33 on gun stock 34 to accomodate screws 35 for securing the mount to the side of the gun.

Figure 3:
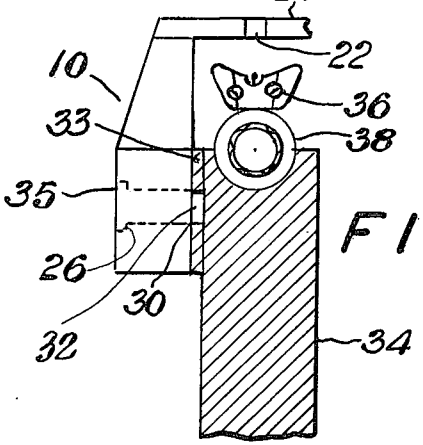
FIG. 3 is an end view of one embodiment of the invention.

In the embodiment shown in FIG. 3 the height of scope carrier 20 is such as to clear the iron sights 36 mounted over barrel so as to allow use of either iron sights or of the scope. With this version, if the scope is damaged while on the rifle, the hunter can tilt his head forward bringing into vision the iron sight.

Figure 4:
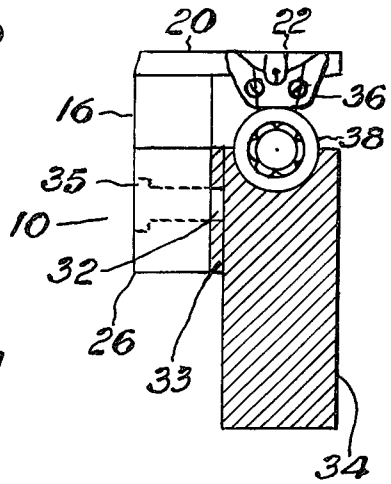
FIG. 4 is an end view of another embodiment allowing use of a telescopic sight only.

In the version of FIG. 4, the scope carrier 20 is just over the plane of gun sights 36.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A telescopic gun sight mounting device adaptable for attachment of a telescopic sight to a "Winchester" 1894 model rifle, wherein said rifle is formed with a gun barrel, to which a fixed sight is mounted over the said gun barrel and wherein said rifle is formed with a gun receiver in which spaced screw holes are located in a side portion of said gun receiver, and where said rifle is equipped with a cartridge ejection port that opens to the top of said rifle, said device comprising an elongated mounting bracket formed of a first portion that extends along a vertical plane when a second portion of the bracket extends along a horizontal plane, said second portion extending from a side of the upper front section of the said first portion, with said first portion formed in its lower rear section with a plurality of holes located so as to align with the spaced screw holes in the gun receiver, said second portion being substantially flat and formed with spaced openings for screws for securing a telescopic sight above said second portion, in which said bracket is of a size and shape so that with said first portion fastened by screws through the said holes in the said first portion to the gun receiver of a said "Winchester" 1894 model rifle, the said second portion extends above the barrel of the rifle forward of the cartridge ejection port and such that a telescopic sight mounted by screws through the spaced openings of the said second portion extends forward of the said ejection port.

2. The combination as recited in claim 1 in which the said first portion is of a size and shape so that the said second portion and telescopic sight, mounted by screws to the said second portion, extends above the sight fixed to the gun to permit alternative use of either the sight fixed to the gun or the telescopic sight when the device is installed on a said rifle.

* * * * *